United States Patent [19]

Gueret

[11] Patent Number: 4,962,626

[45] Date of Patent: Oct. 16, 1990

[54] METHOD FOR COMPACTING A POWDER-BASED COSMETIC MATERIAL

[75] Inventor: Jean-Louis Gueret, Paris, France

[73] Assignee: L'Oreal, Paris, France

[21] Appl. No.: 248,627

[22] Filed: Sep. 26, 1988

[30] Foreign Application Priority Data

Sep. 29, 1987 [FR] France ..... 87-13424

[51] Int. Cl.[5] ..... B65B 1/24; B65B 61/18; B65B 63/08

[52] U.S. Cl. ..... 53/412; 53/436; 53/527; 53/440

[58] Field of Search ..... 53/410, 412, 436, 527, 53/242, 243, 440; 100/93 P; 132/293; 264/112; 206/581, 823; 141/12, 80, 82

[56] References Cited

U.S. PATENT DOCUMENTS

| | | | |
|---|---|---|---|
| 280,478 | 7/1883 | Hunter | 141/82 |
| 1,468,000 | 9/1923 | Buedingen | 206/823 X |
| 1,596,117 | 8/1926 | Pinkett | 100/93 D |
| 1,694,325 | 12/1928 | Kendall | 132/293 |
| 1,856,743 | 5/1932 | Brooks | 206/823 X |
| 2,260,456 | 10/1941 | Johnson | 141/80 X |
| 2,365,920 | 12/1944 | Vaughn | 53/436 |
| 2,365,922 | 12/1944 | Vaughn | 53/428 |
| 2,573,141 | 10/1951 | Heinrich | 141/80 X |
| 2,731,777 | 1/1956 | Wollersheim | 141/80 X |
| 3,468,095 | 9/1969 | Vogt | 53/527 X |
| 4,131,211 | 12/1978 | Corbic | 215/2 |
| 4,337,859 | 7/1982 | Murphy | 206/823 X |
| 4,495,209 | 1/1985 | Whiteside | 215/2 |
| 4,660,608 | 4/1987 | Arai | 141/80 X |

FOREIGN PATENT DOCUMENTS

| | | | |
|---|---|---|---|
| 113137 | 6/1941 | Australia | 132/293 |
| 899108 | 12/1953 | Fed. Rep. of Germany . | |
| 2573290 | 5/1986 | France . | |
| 274687 | 7/1927 | United Kingdom | 100/93 D |

*Primary Examiner*—John Sipos

*Attorney, Agent, or Firm*—Cushman, Darby & Cushman

[57] ABSTRACT

A quantity of the powdered preparation (2), advantageously including a binder, is placed in a container (1) which is open in its upper portion and the lower portion of which is defined by a tray (4) intended to contain the resultant compact at the end of the operation. The hot compression of the preparation (2) is performed, the compacting piston (13) being equipped with a heating device (14). The heating makes the compact more cohesive, and if a binder is present, increases its fluidity. The invention offers the possibility of using microencapsulated binders as well as hydrophobic binders. The invention can be used for compacted makeup powders.

19 Claims, 1 Drawing Sheet

METHOD FOR COMPACTING A POWDER-BASED COSMETIC MATERIAL

FIELD OF THE INVENTION

The present invention relates to the field of cosmetic preparations comprised by dry compressed powders or mixtures of dry compressed powders, or mixtures of powder and anhydrous binders; these cosmetic preparations, which advantageously include colored or tinted pigments, are used in particular for making up the face and are often known as "compacts".

BACKGROUND OF THE INVENTION

It is generally known that this type of powder comprises a powdered base, selected in particular from the group including talc, rice starch, kaolin, silk powder or polymer powder, to which pigments are added to obtain a coloration, examples being the oxides of titanium, zinc or iron. If a pearly effect is desired, a mica powder or a powder of mica coated with metal oxides, in particular of titanium and bismuth, or aluminum powders is added. To obtain sufficient adherence to the skin, a small quantity of binder is typically added, for example vegetable, animal, mineral or synthetic oils, zinc stearate, sorbitol or lanolin. These powders may also contain preservatives such as methylparaben or propylparaben, surfactants (preferably nonionic), and fragrances.

To obtain a makeup compact, the fluid base powder is disposed on the bottom of a container, in which a piston or punch, which compresses the powder to assure the cohesion of its grains, is made to slide. In general, it is arranged that the container is defined at its bottom by a tray that receives the resulting compact product.

The goal of this compacting operation is to obtain the greatest possible cohesion of the grains of the base powder, to prevent the compact from crumbling; this result, which depends on the texture of the powder that is compacted, is not always easy to attain. Moreover, binders may be used in combination with the powder to modify the texture of the compact or to improve its cohesion; in that case, the binders must be distributed evenly and homogeneously throughout the product during compacting, which in practice is no always attained.

SUMMARY OF THE INVENTION

The present invention overcomes the above-described problems.

According to the invention, the compacting is performed hot, rather than at ambient temperature. Under these conditions, the grains of the base powder adhere more strongly to one another, leading to the desired effect. The binders, if present, are thus increased in fluidity, and as a result, they disperse more easily and quickly throughout the product during the compacting. With hot compression, it is then possible to introduce less binder than when working at ambient temperature, for the same cohesion of the final compact; the texture of this compact will then be more "powdery", which facilitates the distribution of the product. Moreover, if a quantity of binder is introduced in a hot operation that is equal to that that would be used when working at ambient temperature, a "creamier" texture of the compact is obtained. Hence the invention makes it possible to select a compact texture from a wider range of textures, by regulating the quantity of binder used.

The invention also provides additional complementary advantages:

It enables the use of microencapsulated binders, which provides ease in handling the compositions to be compacted; the pressure applied during the compacting causes the microcapsules to explode. It also enables the use of hydrophobic binders, such as waxes, which could not be used if heat were not added; the more-hydrophobic compacts obtained produce a more water-resistant makeup.

It has also been found that a compact, obtained in its tray in the conventional manner described above, is not homogeneous over its height, and in particular it is more friable in the region near the bottom of the tray, and is harder in the region on the opposite end, that is, on the surface to which the compacting piston is applied. The reason for this is that the pressure applied to the fluid powder is not transmitted perfectly through the layer of powder, because of the elasticity of the powder. Hence during use, it is easier to take up the powder in a more-friable portion.

In order to take advantage of this feature, the present advantage proposes a technique with which packaging of the compact product can be obtained directly, in which package the user has access to the product via its more-friable portion. To this end, the tray placed in the bottom of the container has at least one opening, the container being defined at the level of the opening or openings by a counterpart base plate. Under these conditions, after the compacting operation, in the final package comprising a case, for example, the resultant tray is inverted, so that the product can be taken up through its opening or openings, from the side that did not directly undergo the action of the compacting piston and hence is less hard.

It has also been found, in the performance of the compacting by a conventional manner, that the edges of the compacts often have flaws, because the compacting is always more homogeneous in the central portion of the compact. With the technique that has just been described, it is sufficient to dispose the opening or openings at the bottom of the tray, primarily in its central region. In this manner, the edges of the compact are concealed in the final package, which lends a more esthetic appearance.

In variant embodiments of this technique, the counterpart plate may be slightly concave vertically of the opening of the tray, so that the compact extends through this opening beyond the bottom of the tray, along a slightly bulging portion, which also lends a more esthetic appearance to the compact as a whole.

Another advantage of this technique is that the aforementioned openings may be of any shape and hence may advantageously be creative or esthetic in shape, but in all cases, the same compacting piston for a tray of a given shape of complete compact can be used. It is sufficient simply to replace the tray each time, in the compacting system, with another tray that includes a different type of opening.

A flexible protective film, which is resistant to the heat that may optionally be applied, and advantageously comprising a tamper-proof film for the powder may be interposed in the compacting system between the counterpart base plate and the tray. The protective film may thus be replaced by a rigid lid in place of the flexible backing; this lid may be obtained by injection and can be firmly attached to the bottom of the tray by snap-locking. Separator bars may also be installed on the bottom of the tray in the compacting container, in such a manner that powders of different types, for example including pigments of different colors or shades, can be compacted in the same operation, in particular to enable including complementary makeup products in the same package.

Hence the subject of the present invention is, first, a method for compacting a powder-based cosmetic preparation, by which a quantity of the powdered preparation is placed in a container that is open in its upper portion, its lower portion being defined by a tray intended to contain the resultant compact cosmetic preparation at the end of the operation, and the compression of the preparation is effected with the aid of a compacting piston displaced in the container substantially perpendicular to the mean plane of the layer of the powdered preparation, characterized in that the compacting is done hot.

Preferably, a compacting piston equipped with a heating device is used. The temperature of the compacting piston is also regulated to a temperature included between 40° and 300° C., for example. The tray, on the one hand, and the powder, on the other, can also be preheated to 100°. in a heating hopper prior to the hot compacting.

Advantageously, a powdered cosmetic preparation which includes at least one binder, in particular from 2 to 15% by weight as a proportion of the entire weight of powdered cosmetic preparation, is used. Among the binders that may be used, liquid petrolatum and castor oil can be given as particular examples. The binders may advantageously be packaged in microcapsules. In this case, at the time of compacting, the compression applied to the powdered composition assures that the microcapsules will explode, the microcapsules being thoroughly mixed with the base powder, and their contents, comprising the binder per se, will expand uniformly and rapidly throughout the base powder, in order to assure good cohesion of the grains of the powder.

According to the invention, for a given cosmetic preparation, a proportion of binder lower than or equal to what would be selected for compacting without adding heat can be selected, in order to obtain a more powdery or more creamy texture, as desired, of the compact cosmetic preparation.

According to the invention, binders having hydrophobic properties, such as waxes, can be used; in this way, a makeup can be obtained the hydrophobic nature of which is reinforced, or in other words, which has better water resistance.

In accordance with an important characteristic of the present invention, in which the tray is intended, along with the compact cosmetic preparation, to comprise an element of the packaging of this preparation, a tray is used the base of which includes at least one opening, the container being defined in the region of the opening or openings by a counterpart base plate on which the tray rests; the surface of the compact cosmetic preparation, which is accessible through this opening or openings, comprises the surface at which, in the final compact cosmetic preparation package, the user takes up this preparation.

In particular, a tray can be used the opening or openings of which is or are made in a central portion of the bottom, the boundary region of the compact cosmetic preparation being protected from the outside, in the final package, by the peripheral zone on the bottom of the tray.

In a variant embodiment, a counterpart base plate can be used the surface of which that faces the opening, or each opening, of the base of the tray is slightly concave, to give the compact a slightly convex surface in this zone that protrudes from the plane of the outer wall of the bottom of the tray.

In addition, a flexible protective backing capable of resting firmly on the tray and its contents after compacting can be disposed between the bottom of the perforated tray and the counterpart base plate. Not only must this backing, in hot compacting, have good resistance to heat, but if the foregoing variant is used it must be made of an extremely flexible material.

In particular, a backing that is fused to the outer edge of the bottom of the tray, or a backing that is completely adhesive on its surface that faces this bottom, can be used, this backing in this case making the compact cosmetic preparation tamper-proof in its associated tray. In the case where the backing is completely adhesive, the surface of the compact product includes a slightly textured effect when the backing is removed, which may be esthetically desirable.

Similarly, at least one bar separating powdered cosmetic preparations of different types may be disposed in the interior of the container, in such a way that the bar rests on the counterpart plate, passing through the openings (or at least one of the openings) of the bottom of the tray, and these preparations can then be compacted simultaneously.

Finally, a film of liquid glue, for example thermofusible glue, can be disposed on the bottom of a case capable of receiving the tray nested in it, the tray containing the associated compact preparation and the bottom of the tray being turned toward the outside, and the glue can be made to harden in order to assure the fixation of the tray to the bottom of the case and to the inner lower edge of the side wall of the case, in order to make the final package of the compact preparation.

The present invention also relates to the compact cosmetic preparations obtained by the above-described method.

The invention will be better understood from the ensuing detailed description of various exemplary embodiments, which are solely illustrative and not limiting, referring to the accompanying drawings.

DESCRIPTION OF THE PREFERRED EMBODIMENTS

Figure 1:
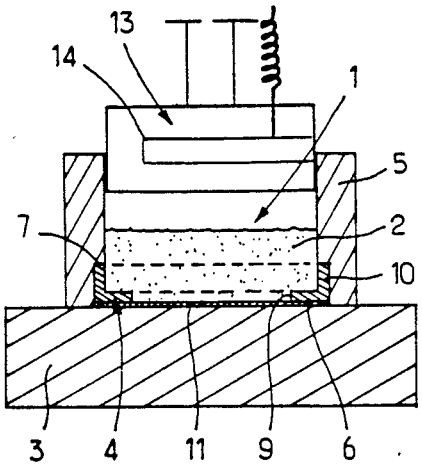
FIG. 1 is a schematic vertical sectional view through a compacting device adapted for performing the method according to the present invention.

Referring to FIG. 1, a container 1 is seen, in which a quantity of powder 2 intended to be compacted has been disposed. The composition of this powder by weight is as follows:

| | |
|---|---|
| talc | 40% |
| pigments | 10% |
| pearlizing agent (mica) | 40% |
| binder (liquid petrolatum, jojoba oil), optionally microencapsulated | 10% |

The quantity of binder is less than the normal quantity that would be used in conventional compacting without adding heat.

The container 1 is defined by a horizontal support 3, serving as a counterpart plate in the operation of compacting the powder 2, by a tray 4 resting on the counterpart plate 3, and by a tubular sleeve 5.

The tray 4, made of plastic, for example, comprises a rectangular bottom 6, to which a side wall 7 of low height is connected. The quantity of fluid powder 2 introduced, and the dimensions of the tray 4, are calculated so that the compacting will produce a flat parallelepiped block (see FIG. 3), the upper surface of which is flush with the free edge of the side wall 7 of the tray 4. The bottom 6 of the tray includes an opening 9 of ellipsoid shape, centered on the center of the bottom 6 and occupying a majority of the surface area of this bottom.

The sleeve 5, of rectangular cross section corresponding to the inside cross section of the tray 4, has an undercut 10 in its inside wall, at a distance from one of its edges that is equal to the height of the tray 4.

For compacting, the tray 4 rests on the counterpart plate 3, with a backing 11 between them, the sleeve 5 being axially nested on the tray 4 in such a way that the free upper edge of the tray comes to abut the undercut 10; the inside surfaces of the wall 7 and sleeve 5 come to be located in the extension of one another.

The backing 11 is a backing of a very flexible plastic material, such as polycarbonate or polyester; its shape and dimensions correspond to those of the bottom of the tray 4. In addition, it is extended laterally by a tab 12, as is readily visible in FIG. 2. The backing 11 is glued by its edge to the periphery of the outer wall of the bottom 6, or else it is adhesive over its entire surface facing the bottom 6 of the tray 4.

A piston 13 is disposed slidably in the container 1. The piston is equipped with a heater device 14, for example an electrical resistor, arranged for the most uniform possible heating of the wall of the piston 13 that is intended for compressing the powder 2.

For the compacting, the piston 13 is applied, with the heater 14 in operation, to the powder 2, the level of which is higher than that of the upper edge of the tray 4, until the compact 8 is obtained. The compacting pressure is between 40 and 400 bars, and it is maintained for from 1 to 15 seconds. The temperature of the piston 13 when it compresses the powder 2 is on the order of 100° to 300° C. Under these conditions, the binder distributes more quickly and better throughout the constituent particles of the base powder. A cohesion of the resultant compact 8 that is at least equivalent to that that would be attained using a normal quantity of binder, in a conventional compacting without adding heat, is obtained. Moreover, the texture of the resultant compact is more powdery, making easier distribution of the powder possible.

Figure 2:
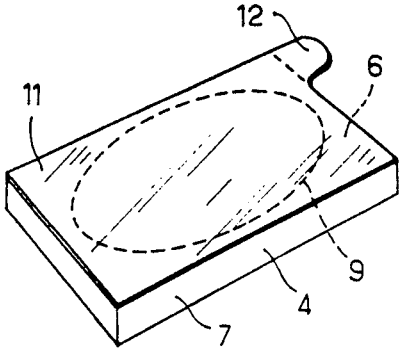
FIG. 2 is a perspective view of the tray containing the compact cosmetic preparation, such as is obtained at the end of the compacting operation by the device of FIG. 1, this tray being shown in the inverted position in order to show the side from which the compact product is taken up.

After the piston is withdrawn and the sleeve 5 is removed, the unit shown in FIG. 2 is obtained, comprising the tray 4, the compact 8 and the backing 11.

Figure 3:
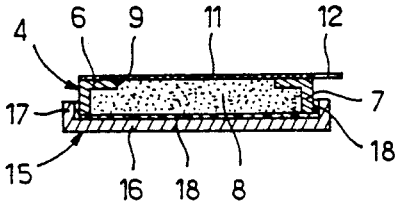
FIG. 3 is a longitudinal section showing the tray of FIG. 1 after emplacement in a presentation case.

This unit is then placed in inverted position, as shown in FIG. 3, into a case 15 the solid bottom 16 of which is connected to a side wall 17, the inside cross section of this case 15 being equal to or slightly larger than the cross section of the tray 4.

Before the unit shown in FIG. 2 is introduced, a film of thermofusible glue 18 in the liquid state is disposed on the bottom 16 of the case 15. The setting of this glue makes it possible to obtain the fixation of the compact 8 to the bottom 16 of the case 15; moreover, while it is still liquid the thermofusible glue 18 rises laterally up the wall 17, to assure totally firm joining of the tray 4 to the case 15.

At the time of use, the backing 11 is pulled off all in one piece, by grasping the tab 12, and access to the compact 8 is then available through the opening 9 of the tray. Access to the compact product is gained here through the least hard part of the compact 8, because of the manner in which the compact is formed, which further contributes to the ease of taking up the product on the part of the user. Moreover, any flaws on the edge of the compact 8 are hidden from view, because this edge is covered by the periphery of the bottom 6.

In the package shown in FIG. 3, the gluing of the compact 8 to the bottom 16 of the case 15 prevents deleterious cracking of the compact 8 either during use, if the user presses on the compact 8, or during shipment.

Figure 4:
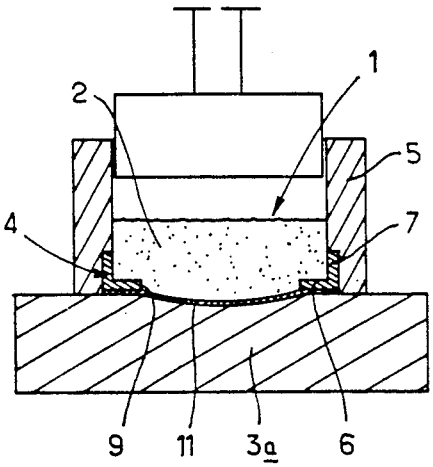
FIG. 4 is a view similar to FIG. 1 of a compacting device, in a variant embodiment.

In FIG. 4, a variant embodiment has been shown in which the counterpart plate 3*a* includes a slightly concave shape in its region that faces the opening 9 in the bottom 6 of the tray 4. In this way, a compact 8 is obtained that protrudes slightly through the opening 9, thus lending an esthetic effect to the resultant package.

Figure 5:
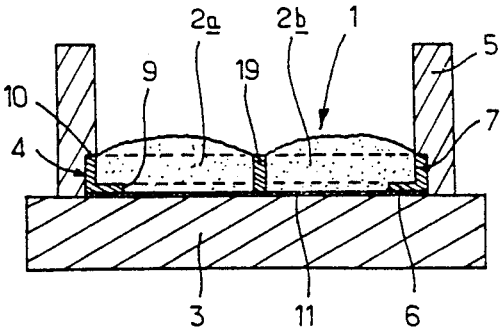
FIG. 5 is a view similar to FIG. 1, illustrating the possibility of making the trays with multiple compartments.
Figure 6:
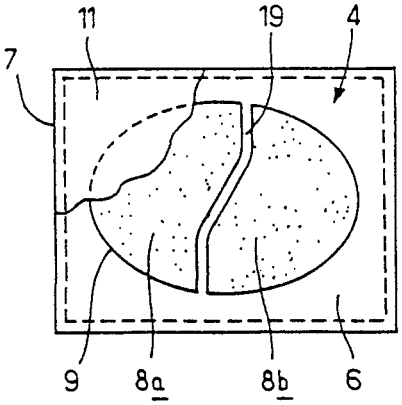
FIG. 6 is a plan view of the tray of FIG. 5, after compacting, showing the takeup surfaces of the compacted products in these compartments.

In FIG. 5, another possibility afforded by the present invention is illustrated, that is, the provision in the container 1, on the bottom 6 of the tray 4, of a transverse separator bar 19 provided between the edges of the bottom 6 defining the opening 9. This bar 19 comprises a means of separation making it possible to introduce two types of powdered substance 2*a*, 2*b* into the container, which for example differ in the color of pigments that they contain and for instance comprise complementary makeup products. The bar 19 may be curved or bent in shape, thus lending an esthetic note to the final packaging of the compact 8.

It will be understood that the embodiments described above are not in any way limiting and may be modified in any desirable manner without departing from the scope of the present invention; in particular, the use of trays having a bottom is possible, this method hence being applicable to both conventional compacting and inverted compacting defined in the French patent application filed by the present applicant on the same date as the present application.

What is claimed is:

1. A method for compacting a powder-based cosmetic preparation comprising the steps of:

providing a container having an open upper portion and also having a lower portion defined by a tray;

placing a quantity of powder-based cosmetic preparation that includes from 2 to 15% by weight of at least one binder in the container;

heating a compacting piston and displacing the compacting piston in the container substantially perpendicular to a mean plane of a layer of the cosmetic preparation to compress the cosmetic preparation into a solid in the tray by the heated piston.

2. A method as defined by claim 1, including the step of using a compacting piston equipped with a heating device.

3. A method as defined by claim 2, including the step of regulating the temperature of the compacting piston to a value included between 40° and 300° C.

4. A method as defined by claim 1, including the step of using at least one binder packaged in microcapsules.

5. A method as defined by claim 1, including the step of selecting for a given powder-based cosmetic preparation, a proportion of binder that is lower than or equal to that which would be selected for compacting without the addition of heat.

6. A method as defined by 1, including the step of using at least one binder having hydrophobic properties.

7. A method as defined by claim 1, in which the tray comprises an element for packaging the cosmetic preparation, including the step of providing that the tray has a bottom which includes at least one opening, such that a surface of the compacted cosmetic preparation is accessible through the opening, this accessible surface comprising a surface for takeup by the user of the cosmetic preparation in a final package.

8. A method as defined by claim 7, including the step of providing that the opening in the tray is in a central portion of the bottom of the tray, and an edge region of the compacted cosmetic preparation is protected in the final package by a peripheral zone of the bottom of the tray.

9. A method as defined by claim 7, including the step of providing that a surface of a counterpart base plate that faces the opening of the bottom of the tray is concave, therein molding a convex surface to the accessible surface of the compacted cosmetic preparation.

10. A method as defined by 7, including the step of providing a flexible protective backing disposed between the bottom of the tray and the counterpart base plate such that the backing rests firmly on the tray after compacting.

11. A method as defined by claim 10, including the step of attaching the backing to the bottom of the tray so that the backing covers the compacted cosmetic preparation to make the compacted cosmetic preparation tamper-proof.

12. A method as defined by claim 11, including the step of attaching the backing to the tray at an outer perimeter of the bottom of the tray.

13. The method as defined by claim 12, including the step of providing that the backing is completely adhesive over one surface and is attached by this adhesive surface to a face of the bottom of the tray.

14. A method as defined by claim 10, including the step of providing that the backing can be pulled off in one piece by means of a lateral pull tab.

15. A method as defined by claim 7, including the step of providing that cosmetic preparations of different types disposed inside the container are separated by at least one bar resting on the counterpart base plate through the opening in the bottom of the tray, and the different cosmetic preparations are compacted simultaneously.

16. A method as defined by claim 7, including the step of providing that a film of glue is disposed on an interior of a case that receives the compacted cosmetic preparation filled tray in nested fashion, such that the bottom of the tray is exposed; after hardening, the glue affixes the tray to the interior of the case.

17. A method as defined by claim 7, including the step of providing that a rigid lid is disposed between the bottom of the tray and the counterpart base plate and rests firmly on the tray after compacting.

18. A method as defined by claim 1, including the step of preheating the tray and cosmetic preparation prior to the compacting under heat.

19. A method as defined by claim 1 including the step of obtaining a compacted cosmetic preparation.

* * * * *